US007034458B2

(12) United States Patent
Asida et al.

(10) Patent No.: US 7,034,458 B2
(45) **Date of Patent: *Apr. 25, 2006**

(54) MULTI-LAYERED SHAPED ELECTRODE

(75) Inventors: Hideki Asida, Kadoma (JP); Shinya Fujiwara, Kyoto (JP); Hideki Marunaka, Kyoto (JP); Tadashi Nakagawa, Takatsuki (JP); Keisuke Sumida, Hirakata (JP); Hideaki Yasui, Hirakata (JP); Kazuhiko Sugimoto, Ibaraki (JP); Hiroyosi Tanaka, Kyoto (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/053,006

(22) Filed: Feb. 8, 2005

(65) Prior Publication Data

US 2005/0134177 A1 Jun. 23, 2005

Related U.S. Application Data

(62) Division of application No. 09/857,721, filed as application No. PCT/JP00/07225 on Oct. 18, 2000, now Pat. No. 6,869,751.

(30) Foreign Application Priority Data

Oct. 19, 1999 (JP) ..... 11-296323
Dec. 16, 1999 (JP) ..... 11-357232

(51) Int. Cl.
*H01J 17/49* (2006.01)

(52) U.S. Cl. ..... 313/582; 313/583; 313/584

(58) Field of Classification Search ..... 257/773, 257/780, 781; 313/582–584
See application file for complete search history.

(56) References Cited

U.S. PATENT DOCUMENTS 4,205,364 A * 5/1980 Pereira, Jr. ..... 361/274.1
5,312,703 A 5/1994 Wagenblast et al. ..... 430/19
5,821,626 A * 10/1998 Ouchi et al. ..... 257/778
6,380,061 B1 * 4/2002 Kobayashi et al. ..... 438/613
6,396,665 B1 * 5/2002 Asano ..... 360/264.2
6,891,331 B1 * 5/2005 Ashida et al. ..... 313/582

OTHER PUBLICATIONS

"NEW Plasma Display Manufacturing Technology," Saishin Plasma Display Seizo Gijutsu (Japan) Press Journal, Dec. 1, 1997, pp. 96-100 (with English translation).

* cited by examiner

*Primary Examiner*—Cathy F. Lam

(57) ABSTRACT

A manufacturing method for a metal electrode used for a bus electrode, a data electrode, and the like which make up a display panel including a PDP (Plasma Display Panel) by which, when these electrodes are patterned according to a photolithographic method, the edge curl phenomenon can be substantially controlled to the extent that the phenomenon is negligible. The manufacturing method of the invention therefore includes a dry step for drying the layers making up the metal electrode so that flows (F1, F2, and F3) of the solvent occur from a region having a high absorbency of the solvent to a region having a lower absorbency of the solvent.

11 Claims, 16 Drawing Sheets

MULTI-LAYERED SHAPED ELECTRODE

This application is a divisional application of U.S. Ser. No. 09/857,721, filed on Jul. 16, 2001 and issued as U.S. Pat. No. 6.869,751 on Mar. 22, 2005 which a 371 of PCT/JP00/07225 filed Oct. 18, 2000.

TECHNICAL FIELD

The present invention relates to improvements in a method for producing a metal electrode used for a plasma display panel or the like.

BACKGROUND ART

FIG. 14 shows an example of a conventional plasma display panel (hereafter called "PDP"). This figure is a perspective view, partly in cross section, of an AC PDP.

As shown in this figure, the AC PDP is composed of a front panel 75 and a back panel 85 which are opposed to each other. The front panel 75 is formed with a plurality of pairs of a stripe-shaped scanning electrode 71 and a stripe-shaped sustaining electrode 72 which are placed in parallel on a transparent first glass substrate 70 (an insulate substrate) and are covered by a dielectric layer 73 and a protective layer 74. The back panel 85 is formed with a plurality of stripe-shaped data electrodes 81 which are placed on a second glass substrate 80 (an insulate substrate), extend orthogonally to the scanning electrodes 71 and sustaining electrodes 72, and are covered by a dielectric layer 82. A plurality of stripe-shaped partition walls 83 are placed in parallel on the dielectric layer 82 so as to be located above and between the data electrodes 81. Also, phosphor layers 84 in different colors are provided along sides of the partition walls 83.

A space formed between the front panel 75 and the back panel 85 is filled with an inert gas including one or more type of gases selected among He, Ne, Ar, Kr, and Xe as a discharge gas. In this space, a portion where the scanning electrode 71, the sustaining electrode 72, and the data electrode 81 intersect together constructs a light-emitting cell 90 (also referred to as a discharge space).

The scanning electrode 71 and the sustaining electrode 72 are made up of stripe-shaped conductive transparent electrodes 71*a* and 72*a*, and bus electrodes 71*b* and 72*b* which are formed on the transparent electrodes, are narrower than the transparent electrodes, and include Ag. The data electrode 81 also includes Ag.

This AC PDP operates as follows. In a period for sustaining a driving operation after initialization and an address period, a pulse voltage is alternately applied to the scanning electrode 71 and the sustaining electrode 72. Then, an electric field developed between the protective layer 74 on the scanning electrode 71 across the dielectric layer 73 and the protective layer 74 on the sustaining electrode 72 across the dielectric layer 73 generates a sustaining discharge in the discharge space 90. Ultraviolet rays from this sustaining discharge excite phosphors in the phosphor layer 84, which causes emission of visible light. This visible light forms an image on the panel.

Here, a method for forming the scanning electrode 71, the sustaining electrode 72, the dielectric layer 73, and the protective layer 74 on the first glass substrate will be briefly described. First, stripe-shaped conductive transparent electrodes 71*a* and 72*a* consisting of tin oxide or indium-tin oxide (ITO) are formed on the first glass substrate 70. Then, a photosensitive paste including Ag is deposited thereon, patterned according to photolithographic method, and baked to form stripe-shaped bus electrodes 71*b* and 72*b* including Ag. Then, a dielectric glass paste is printed thereon and baked to form the dielectric layer 73. After that, magnesium oxide (MgO) is deposited by evaporation to form the protective layer 74.

Next, a method for forming the data electrode 81, the dielectric layer 82, the partition wall 83, and the phosphor layer 84 on the second glass substrate will be briefly described. First, a photosensitive paste including Ag is deposited on the second glass substrate 80, patterned according to a photolithography method, and baked to form stripe-shaped data electrodes 81 including Ag. Then, a dielectric glass paste is printed thereon and baked to form the dielectric layer 82. After that, the partition walls are formed according to a screen-printing method, a photolithography method, or the like, and the phosphor layers 84 are formed according to a screen-printing method, an ink-jet method, or the like.

Then, a glass member for seal is inserted between the peripheral portions of the front panel 75 and the back panel 85, and this glass member is fused and cooled so as to seal the both substrates. After that, exhausting and gas filling processes are conducted to complete the panel.

As stated above, the bus electrodes 71*b* and 72*b* and the data electrodes 81 are formed according to the photolithography method using an Ag photosensitive paste. The following describes these processes in detail using figures. FIG. 15 shows manufacturing processes in the photolithography method. In this figure, the method is explained by showing an example of the front panel.

First, ITO is deposited by evaporation onto the first glass substrate 70. Then, an Ag photosensitive paste is applied according to a printing method or the like to form an Ag photosensitive paste layer 100 (FIG. 15A). Next, a drying process is performed in order to drive off a solvent included in the Ag photosensitive paste layer 100.

Next, the layer 100 is exposed to ultraviolet radiation through a photolithographic mask 102 to form exposed regions 103 and unexposed regions 104 (FIG. 15B). This exposed regions serve as patterns of the bus electrodes in the finished products.

Next, a development process is performed to fix the exposed regions on the first glass substrate 70 (FIG. 15C). These fixed portions in the development process are referred to as a pre-baking electrode structure 105.

Next, the pre-baking electrode structure 105 is baked into the bus electrodes (FIG. 15D). In this process, the pre-baking electrode structure 105 is reduced in the size as can be seen from the comparison between FIGS. 15C and 15D (Note that these figures are slightly exaggerated in their size for purposes of illustration).

In this way, a patterning process according to the photolithographic method using the Ag photosensitive paste is necessarily accompanied by the baking process in order to drive off a resin component in the paste. This process, however, has given rise to a problem of "edge curl phenomenon". It can be thought that this phenomenon mainly results from the action of the tensile force generated by heating.

FIG. 15D includes an enlarged view of the bus electrodes, which shows this edge curl phenomenon. The edge curl phenomenon, as shown in this figure, is a state where both sides of the pre-baking electrode structure 105 for the bus electrodes are warped upward against the first glass substrate after the baking process. When this phenomenon occurs, it becomes difficult to form the dielectric layer on the portions, and the dielectric layer formed on the portions becomes susceptible to an electrical breakdown because the portions have sharp edges. To address the problem, the edge curl portions of the post-baked bus electrodes and data electrodes may be ground away.

Meanwhile, in case that the bus electrodes provided on the front panel are formed using a substance including Ag as above, incident light is reflected by the bus electrodes due to a relatively large reflectivity of Ag, which remarkably deteriorates a contrast in the image on the panel. To cope with this problem, an optically double-layered structure in which a black-white multiple layer and a white layer is laminated has been in practical use as the bus electrodes provided on the front panel. In this structure, the multiple layer configured so that a metal layer including a black pigment and a metal layer including Ag are laminated ("black-white multiple layer") is formed on the first glass substrate, and an Ag metal layer of low resistance ("white layer") is formed thereon.

This double layered bus electrodes are also formed according to the photolithographic method as shown in FIGS. 16A to 16F in the same manner as in the above single layer.

That is, as shown in FIG. 16A, a photosensitive paste including a black pigment is applied to form a printed layer 110. Next, a drying process is performed to drive off a solvent from the printed layer 110.

Next, as shown in FIG. 16B, an Ag photosensitive paste is applied to the surface of the printed layer 110 to form a printed layer 111. Next, a drying process is performed to drive off solvents from the printed layers 110 and 111.

Next, as shown in FIG. 16C, these layers are exposed to ultraviolet radiation through a photolithographic mask 113 to form exposed regions 114 and unexposed regions in the printed layers 110 and 111. These exposed regions serve as patterns of the black-white multiple layer in the finished products.

Note that the above FIGS. 16A to 16C are slightly exaggerated in their film thicknesses or the like for the sake of clarity.

Next, a development process is performed to fix the exposed regions 114 on the first glass substrate 70 (FIG. 16D).

Next, a layer configured as lamination of a layer 116*a* including the black pigment and a layer 116*b* including Ag is baked into a black-white multiple layer 116 (FIG. 16E).

Next, as shown in FIG. 16F, a white layer 117 is applied according to a photolithographic method, a screen-printing method, or the like and baked to complete the bus electrodes.

As shown in the cross-sectional view, the black-white multiple layer in the process of FIG. 16E has the edge portions which are warped upward ("edge curled") so that a concave portion 116*c* is formed at the top of the layer. Then, an Ag photosensitive paste is selectively applied to the concave portion 116*c* according to a photolithographic method, a screen-printing method, or the like, and this structure is baked again. As a result, as shown in FIG. 16F, a top surface of the electrode becomes flat in the finished bus electrode, so that an influence by the edge curl phenomenon in the black-white multiple layer can be substantially avoided.

This method provides advantages that an influence by the edge curl phenomenon can be substantially avoided as described above. However, a demand for a matter of convenience by performing the baking process only once cannot be satisfied by the above method.

DISCLOSURE OF THE INVENTION

In view of the above-mentioned problems, the object of the invention is to provide a manufacturing method for a metal electrode used for a bus electrode, a data electrode, and the like which make up a display panel including a PDP by which, when these electrodes are patterned according to a photolithographic method, the edge curl phenomenon can be effectively controlled or substantially removed to the extent that the phenomenon is negligible.

As described above, the edge curl phenomenon results from the tensile force that acts on the pre-baking electrode structure during the baking process. That is, the tensile force due to heat shrinkage acts on the both edge portions of the structure in all directions. If the tensile force that acts on the structure towards the middle portion of the structure becomes larger, the edge portions are warped upward by the force.

Therefore, in terms of the mechanism of the edge curl phenomenon, if a shape of the pre-baking electrode structure becomes so as to keep a balance of the tensile force, it can be thought that the edge curl phenomenon could be effectively controlled.

Then, the inventors have devised the shape of the pre-baking electrode structure, and have hit upon the invention to prevent the edge curl phenomenon.

More specifically, in order to achieve the above object, a method for producing a metal electrode according to the invention includes (a) a printing process in which a photosensitive substance consisting of a mixture of a metal, a photosensitive resin, and a solvent is printed to form a printed layer, (b) a drying process in which the printed layer is dried, (c) an exposing process in which the layer subjected to the drying process is exposed to light in a predetermined pattern, (d) a development process in which the layer subjected to the exposing process is developed to reveal an electrode pattern, and (e) a baking process in which the revealed electrode pattern is baked to shape a metal electrode. In such processes, the drying process is characterized in that flows of the solvent occur from a region which has not dried to a region which has dried by heating the printed layer so that heated regions are unevenly distributed.

The above method for producing the metal electrode allows the shape of the pre-baking electrode structure to keep a balance of the tensile force due to heat shrinkage. Therefore, the edge curl phenomenon can be effectively controlled.

The above photosensitive substance may be a mixture of a metal including at least one type of metal selected from Ag, Cr, Cu, Al, Pt, and Ag—Pd, a photosensitive resin, and a solvent as minimum ingredients.

Also, the inventors had searched for a method for producing a metal electrode having an optically double-layered structure consisting of a so-called black-white multiple layer and a white layer, by which the edge curl phenomenon becomes substantially negligible (as described in the above "Background Art" section), while performing a baking process only once. As a result, the inventors have found a method by standing the phenomenon on its head and positively using the phenomenon.

That is, a manufacturing method for a metal electrode according to the invention includes a first print step for printing a first photosensitive substance that includes a mixture of a first metal, a photosensitive resin, and a solvent to form a first layer; a first dry step for drying the first layer; a first exposure step for producing a predetermined pattern of a first region having a high solvent absorbency and a second region having a lower solvent absorbency than the first region by exposing the first region; a second print step for printing a second photosensitive substance that includes a mixture of a second metal, a photosensitive resin, and a solvent to form a second layer on the first layer, so that a region of the second layer on the first region converts into a third region having a low solvent content and a region of the second layer on the second region converts into a fourth region having a higher solvent content than the third region; a second dry step for drying the first and the second layers so that flows of the solvent from the first and the fourth regions to the third region occur; a second exposure step for exposing the second layer so as to leave the third region of the second layer in the following development step; a development step for developing the whole of the first and the second layers so as to leave the first and the third regions as an electrode pattern and to remove the remaining regions; and a baking step for baking the electrode pattern to shape the metal electrode.

In addition, a manufacturing method for a metal electrode according to the invention includes a first print step for printing a first photosensitive substance that includes a mixture of a first metal, a photosensitive resin, and a solvent to form a first layer; a first dry step for producing a predetermined pattern of a first region having a high solvent absorbency and a second region having a lower solvent absorbency than the first region by heating the first region; a second print step for printing a second photosensitive substance that includes a mixture of a second metal, a photosensitive resin, and a solvent to form a second layer on the first layer, so that a region of the second layer on the first region converts into a third region having a low solvent content and a region of the second layer on the second region converts into a fourth region having a higher solvent content than the third region; a second dry step for drying the first and the second layers so that flows of the solvent from the first and the fourth regions to the third region occur; an exposure step for exposing the whole of the first and the second layers so as to leave the first and the third regions in the following development step; a development step for developing the whole of the first and the second layers so as to leave the first and the third regions as an electrode pattern and to remove the remaining regions; and a baking step for baking the electrode pattern to shape the metal electrode.

According to the above manufacturing methods for the metal electrode, the edge portions of the printed layer formed in the first printing process and subjected to a baking process are warped upward, so that concave portion having an arc-shaped curve is formed at the top of the layer. The printed layer formed in the second printing process has a domical shape in which the bottom has a swell portion which swells downward in the arc shape and the top has a flat portion. Therefore, after the baking process, the second printed layer fits into the concave portion of the first printed layer. In this way, the edge portions of the first printed layer, which are warped upward, contact the curved portion in the domical shape, and the electrode on the whole has a substantially flat top surface, which prevents the warped edge portions from being exposed. Thus, the edge curl phenomenon can be substantially removed by the above method, which includes a baking process only once.

Here, the photosensitive paste used in the first and second printing processes may include the same metal or different metals. In an embodiment which will be described later, the first printing process corresponds to a process as shown in FIG. 5B in which a printed layer 42 is printed, while the second printing process corresponding to a process as shown in FIG. 5D in which a printed layer 46 is printed.

In these processes, the first photosensitive substance may be a mixture of an RuO black pigment, a metal including at least one type of metal selected from Ag, Cr, Cu, Al, Pt, and Ag—Pd, and a solvent as minimum ingredients, while the second photosensitive substance may be a mixture of a metal including at least one type of metal selected from Ag, Cr, Cu, Al, Pt, and Ag—Pd, a photosensitive resin, and a solvent as minimum ingredients.

BEST MODE FOR CARRYING OUT THE INVENTION

FIRST EMBODIMENT

[Construction of the Panel]

Figure 1:
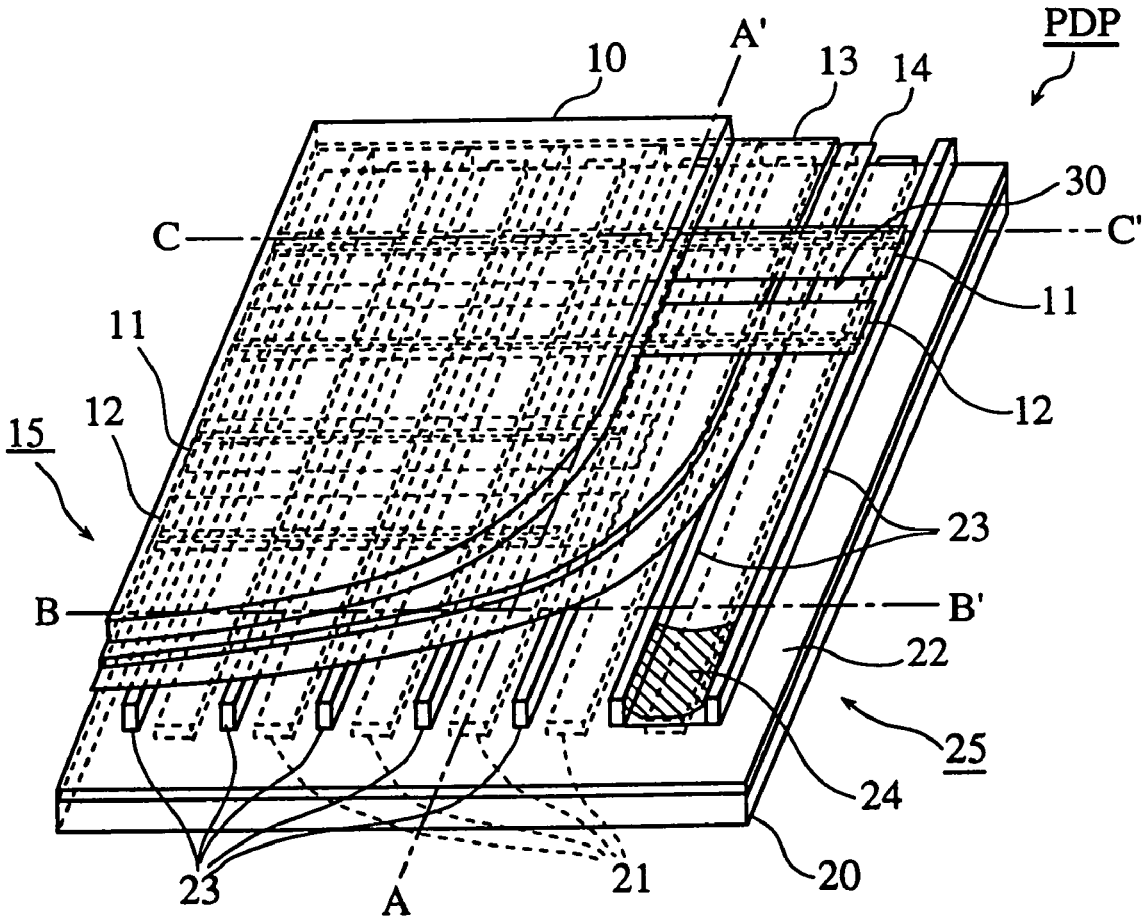
FIG. 1 is a perspective view showing the construction of an AC PDP according to the first embodiment of the invention.

FIG. 1 is a perspective view showing the construction of an AC PDP according to the first embodiment of the invention.

As shown in this figure, the AC PDP is composed of a front panel 15 and a back panel 25 which are opposed to each other. The front panel 15 is formed with a plurality of pairs of a stripe-shaped scanning electrode 11 and a stripe-shaped sustaining electrode 12 which are placed in parallel on a transparent first glass substrate 10 and are covered by a dielectric layer 13 and a protective layer 14. The back panel 25 is formed with a plurality of stripe-shaped data electrodes 21 which are placed on a second glass substrate 20, extend orthogonally to the scanning electrodes 11 and sustaining electrodes 12, and are covered by a dielectric layer 22. A plurality of stripe-shaped partition walls 23 are placed in parallel on the dielectric layer 22 so as to be located above and between the data electrodes 21. Also, phosphor layers 24 in different colors are provided along sides of the partition walls 23. Note that, in this specification, the first glass substrate side of the front panel and the second glass substrate side of the back panel are respectively referred to as "downward" for the sake of convenience.

A space formed between the front panel 15 and the back panel 25 is filled with an inert gas including one or more type of gases selected among He, Ne, Ar, Kr, and Xe as a discharge gas. In this space, a portion where the scanning electrode 11, the sustaining electrode 12, and the data electrode 21 intersect together constructs a light-emitting cell 30.

Figure 2:
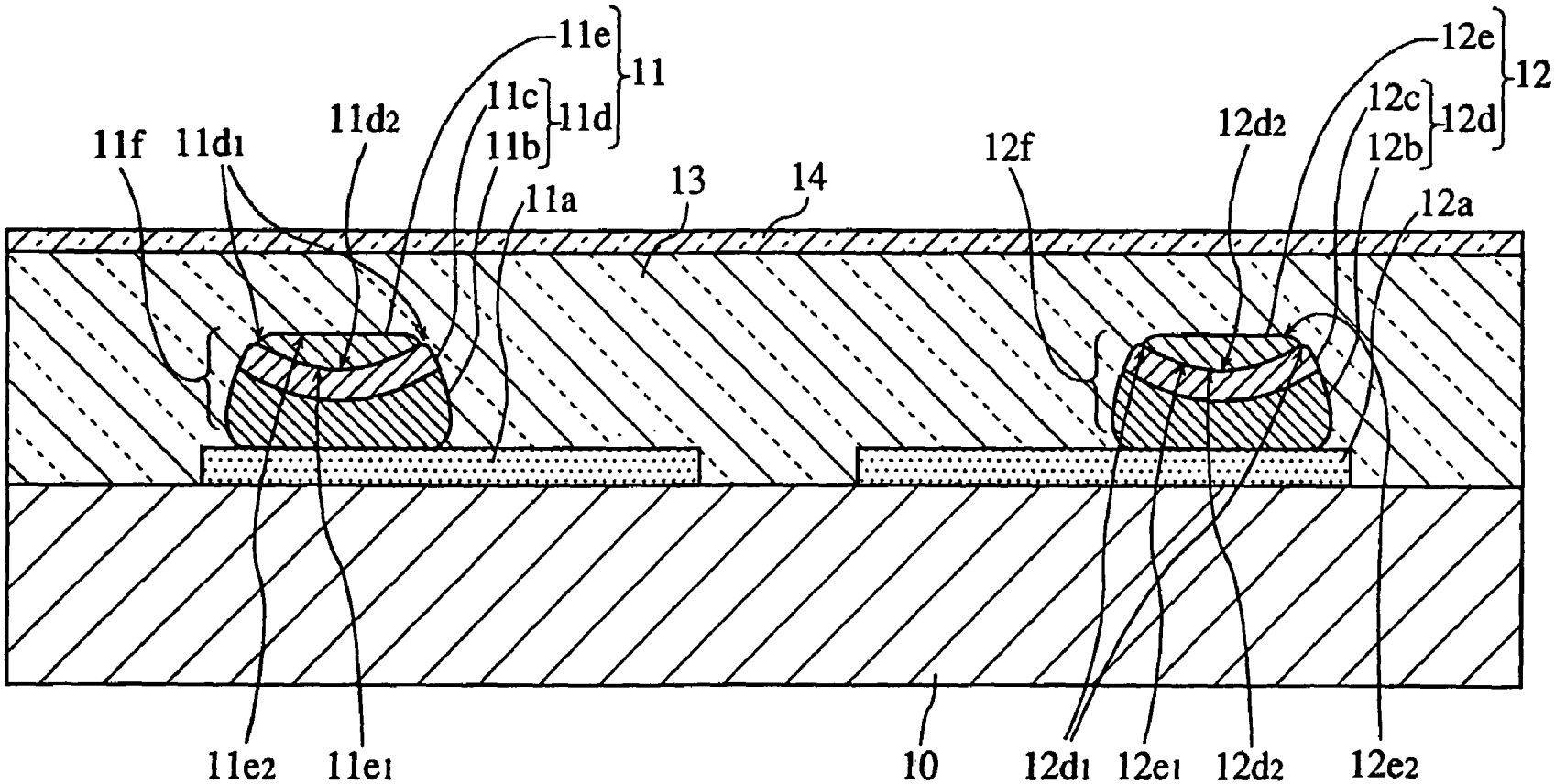
FIG. 2 is a part of vertical sectional view taken along line A-A' of FIG. 1, which shows cross-sectional shapes of the scanning electrode and the sustaining electrode along their short side directions.

FIG. 2 is a part of vertical sectional view taken along line A–A' of FIG. 1, which shows cross-sectional shapes of the scanning electrode and the sustaining electrode along the short side directions.

The scanning electrode 11 and the sustaining electrode 12, respectively, consist of stripe-shaped transparent electrodes 11*a* and 12*a*, stripe-shaped first black conductive layers 11*b* and 12*b* which are narrower than the transparent electrodes, low-resistance second conductive layers 11*c* and 12*c* (the first conductive layer 11*b* and the second conductive layer 11*c* are referred to as a "black-white multiple layer 11*d*", while the first conductive layer 12*b* and the second conductive layer 12*c* are referred to as a "black-white multiple layer 12*d*"), and the third conductive layers 11*e* and 12*e* (hereafter called "white layers 11*e* and 12*e*"), which are laminated in this order. In this way, in terms of the function (especially, optical function) for the metal electrode to absorb the incident light, the first embodiment is the same as conventional one in that a metal electrode is made up of the optically double-layered structure which consists of the black-white multiple layer and the white layer. Hereafter, the electrode structures, in which the black-white multiple layer 11*d* and the white layer 11*e*, and the black-white multiple layer 12*d* and the white layer 12*e* are laminated, are referred to as a bus electrode 11*f* and a bus electrode 12*f*.

The edge portions 11*d*1 and 12*d*1 of the black-white multiple layers 11*d* and 12*d* are warped upward and concave portions 11*d*2 and 12*d*2 having arc-shaped curves are formed at their top. The white layers 11*e* and 12*e* are shaped like a dome, in which bottoms have swell portions 11*e*1 and 12*e*1 which swell downward in the arc shape and tops have flat portions 1*e*2 and 12*e*2. The white layers 11*e* and 12*e* having the above distinctive shapes fit into the black-white multiple layers 11*d* and 12*d* respectively, so that the swell portion 11*e*1 (12*e*1) and the concave portion 11*d*2 (12*d*2) are mutually matching.

Figure 3:
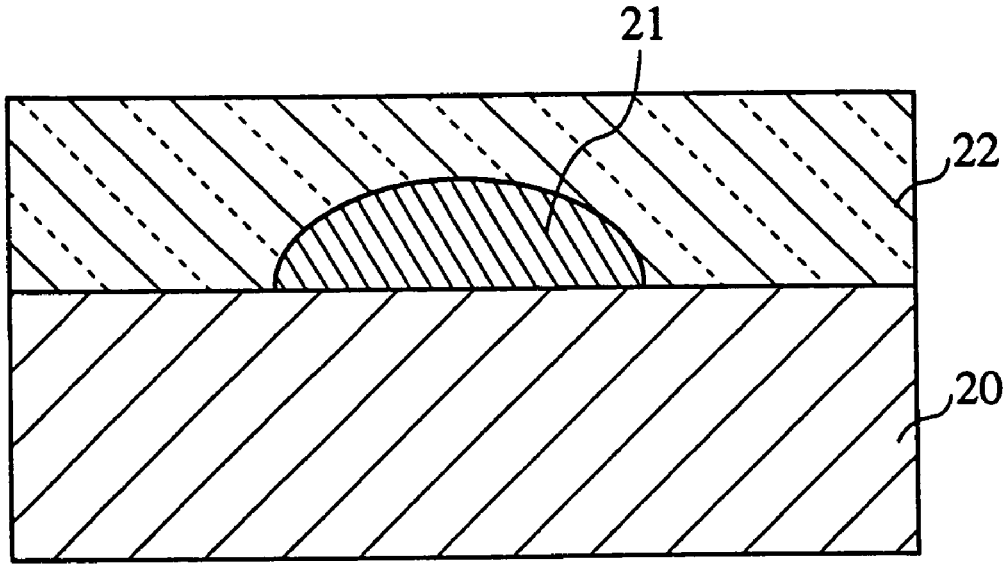
FIG. 3 is a part of vertical sectional view taken along line B–B' of FIG. 1, which shows a cross-sectional shape of the data electrode along the short side direction.

FIG. 3 is a part of vertical sectional view taken along line B–B' of FIG. 1, which shows a cross-sectional shape of the data electrode along the short side direction.

As shown in this figure, the data electrode 21 is a single layer and has a dome shape, in which the center portion is the thickest and swells upward against the substrate and the thickness is decreased in a curvature with increasing proximity to the edge portions. This shape of the data electrode results from the manufacturing method which will be described later.

The following describes the construction of the periphery of the above-mentioned AC PDP.

Figure 4:
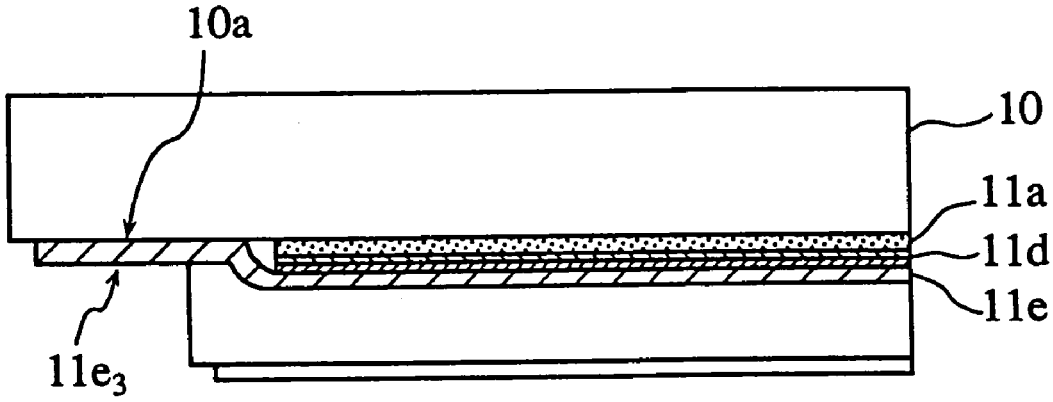
FIG. 4 is a vertical sectional view taken along line C–C' (a line running a region including both transparent electrode and bus electrode) of FIG. 1 along the longitudinal direction of the scanning electrode 11.

FIG. 4 is a vertical sectional view taken along line C–C' (a line running a region including both transparent electrode and bus electrode) of FIG. 1 along the longitudinal direction of the scanning electrode 11, which shows the peripheral portion of the panel (not shown in FIG. 1). Note that the following description applies to not only the scanning electrode 11 but also the sustaining electrode 12, because they have the same construction.

As shown in this figure, the end portion 11*e*3 (12*e*3) of the stripe-shaped third conductive layer 11*e* (12*e*) along the longitudinal direction of the stripe is prolonged to the periphery 10*a* of the first glass substrate so as to connect to the external circuit (not shown). The data electrode 21 is also prolonged to the periphery of the second glass substrate so as to connect to the external circuit, which is not illustrated.

[Method for Manufacturing the Panel]

Basically, the panel can be manufactured according to a well-known method such as the method described in the above "Background Art" section. The following describes a method for manufacturing some components which are specific to the embodiment of the invention.

A) Method for Manufacturing Bus Electrodes 11*f* and 12*f*:

The bus electrodes 11*f* and 12*f* are manufactured as follows. FIG. 5 shows their processes.

Figure 5A:
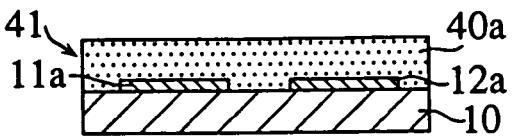
FIG. 5 shows processes by which a bus electrode is manufactured in this order.

As shown in FIG. 5A, a photosensitive paste 40*a* is printed like a film (i.e., layer) on the top surface of the first glass substrate 10 on which the transparent electrodes 11*a* and 12*a* have been formed so as to cover the transparent electrodes 11*a* and 12*a*, whereby a printed layer 41 is formed. This photosensitive paste consists of a mixture of a black pigment, a photopolymerizability monomer, a polymerization initiator, a solvent, a glass component, and the like. Ruthenium tetroxide or a multiple oxide of ruthenium can be used as the black pigment. In addition, it is possible to blacken the electrode using a mixture of Ag and an inorganic pigment such as Fe, Ni, Co, and so on. In this case, however, when a glass substrate manufactured according to a float process, which is generally employed, is used as the first glass substrate, Ag is diffused into the glass substrate during the following baking process because tin is diffused and implanted into the surface of the glass substrate. This diffusion gives rise to a problem of yellowing of the glass substrate. Therefore, it is preferable to use ruthenium tetroxide or the like as above. The photopolymerizability monomer is not limited to a specific type, but acrylate or the like may be used. Diethylene glycol or the like may be used as the solvent.

Figure 5B:
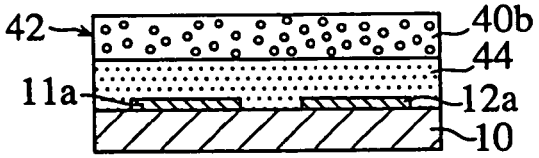

Next, after drying the printed layer to drive off the solvent as shown in FIG. 5B, a photosensitive paste 40*b* is printed like a film (i.e., layer) so as to cover the printed layer 41 to form a printed layer 42. This photosensitive paste 40*b* consists of a mixture of a metal such as Ag, Cr, and Cu which has a low resistance and an enough transparency, a polymerization initiator, a photopolymerizability monomer, a solvent, a glass component, and the like.

Figure 5C:
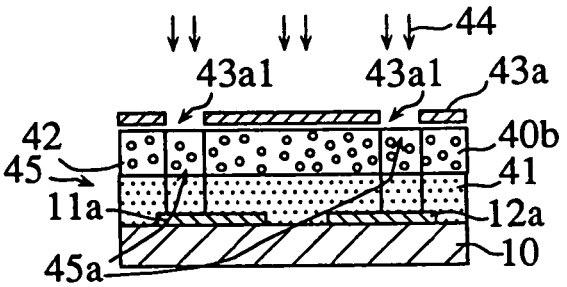

Next, after drying the printed layer 42 to drive off the solvent as shown in FIG. 5C, a photolithographic mask 43*a* with a plurality of slits 43*a*1 in a predetermined pattern is placed above the printed layer 42 with a space of 100 μm between them. Then, the top surface of the printed layers 42 is exposed to ultraviolet radiation 44 through the photolithographic mask 43. This induces a crosslinking reaction in the photopolymerizability monomer included in the portion of the printed layers 41 and 42 under the exposed region. These printed layers 41 and 42 which were subjected to the exposure process hereafter will be called "printed-exposed layer" 45 for convenience.

Figure 5D:
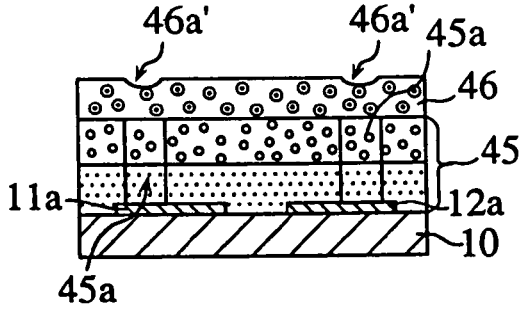

Next, as shown in FIG. 5D, the above photosensitive paste 40*b* is printed like a film (i.e., layer) so as to cover the printed-exposed layer 45 to form a printed layer 46. In the printed layer 46, a portion 46*a*' located on the exposed region 45*a* in the printed-exposed layer 45 is recessed downward (to the substrate side) as shown in FIG. 5(*d*). Here, since the white layer located in the top of the bus electrode is prolonged to the periphery of the panel beyond the display area, the photosensitive paste 40*b* is applied so as to cover the peripheral portion of the layer.

Figure 5E:
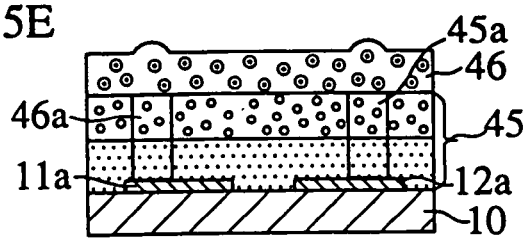

Next, the printed layer 46 is dried in a predetermined temperature profile to drive off the solvent (FIG. 5E). In the drying process, the temperature profile is determined so that the recessed portion 46*a*' (FIG. 5D) becomes swelling like a domical shape. More specifically, this may be a profile of rising an ambient temperature to approximately 80 to 110° C. at a rate of 10 to 40° C./min and keeping the temperature during a fixed time period as one example. As a result, the recessed portion before the drying process can be swelled like a domical shape by the mechanism which will be described later. Note that this temperature profile is important to form the domical shaped portion and ordinary used drying conditions cannot realize this state.

Figure 5F:
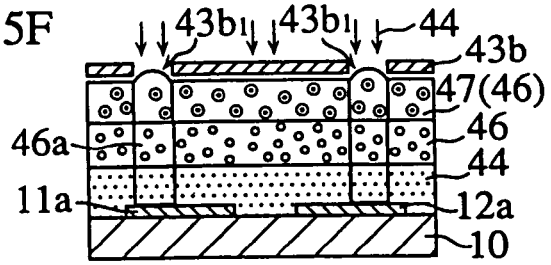

Next, as shown in FIG. 5F, a photolithographic mask 43*b* with a plurality of slits 43*b*1 in a predetermined pattern (this slit is formed corresponding to the recessed portion 46*a*') is placed above the printed layer 46 with a space of 100 μm between them. Then, the printed layer 46 is exposed to ultraviolet radiation 44 through the mask. This printed layer 46 which were subjected to the exposure process hereafter will be called "printed-exposed layer 47" for convenience. Note that, in these figures, the illustration of their film thickness and the like are exaggerated for clarity.

Figure 5G:
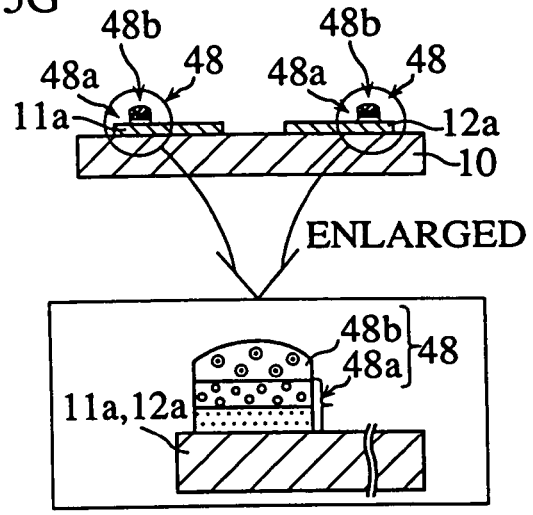

Next, as shown in FIG. 5G, a development process is performed to both of the printed-exposed layers 45 and 47 using a suitable solution (for example, an $Na_2CO_3$ solution or the like) to fix a bus electrode pattern. The strata fixed after the development process will be called "pre-baking electrode structure 48" for convenience. Also, in this pre-baking electrode structure 48, a portion which will become a black-white multiple layer and a portion which will become a white layer will be called a "pre-baking black-white multiple layer 48*a*" and a "pre-baking white layer 48*b*", respectively.

Figure 5H:
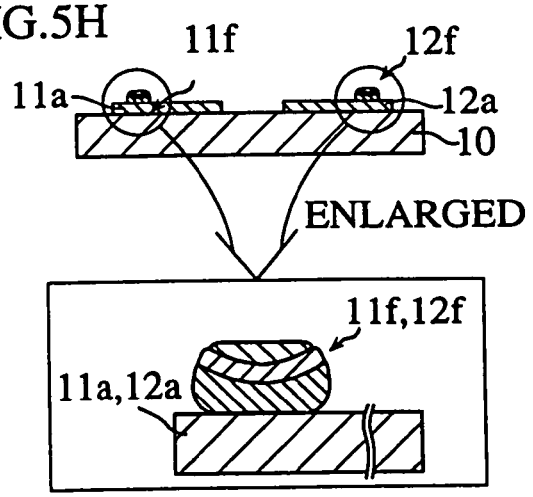

After that, polymers generated by the crosslinking reaction and remaining monomers which have not yet reacted are dissipated by baking the pre-baking electrode structure at a predetermined temperature of 600° C. (FIG. 5H). Thereby, bus electrodes 11*f* and 12*f* are completed. In the baking process, the size of the bus electrodes 11*f* and 12*f* are naturally reduced as compared to the pre-baking electrode structure 48.

Although the exposure pattern of the printed layers 41 and 42 can be formed at the same time as described above, this patterning process may be individually performed to each layer.

B) Method for Manufacturing Data Electrode 21:

The data electrode 21 is manufactured as follows. FIG. 6 shows their processes.

Figure 6A:
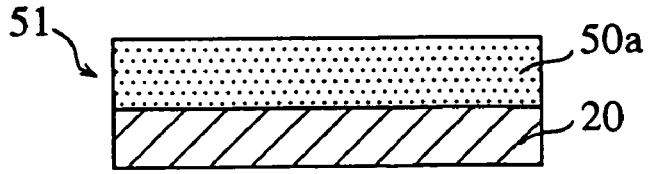
FIG. 6 shows processes by which a data electrode is manufactured in this order.

First, as shown in FIG. 6A, a photosensitive paste 50*a* is printed like a film (i.e., layer) on the top surface of the second glass substrate 20 to form a printed layer 51. The photosensitive paste 50*a* consists of a mixture of a metal such as Ag, Cr, and Cu which has a low resistance and an enough transparency, a polymerization initiator, a photopolymerizability monomer, a solvent, a glass component, and the like. The photopolymerizability monomer is not limited to a specific type, but acrylate or the like may be used like the above example. Diethylene glycol or the like may be used as the solvent. Since the data electrode 21 is prolonged to the periphery of the panel beyond the display area, the photosensitive paste 50*a* should be applied substantially all over the surface of the second glass substrate so as to cover the peripheral portion.

Figure 6B:
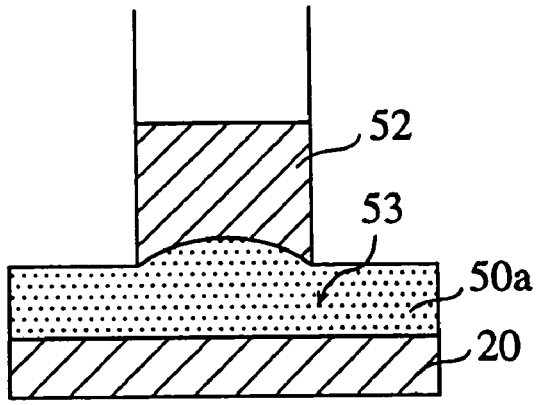

Then, as shown in FIG. 6B, a laser beam 52 is irradiated while being scanned to a predetermined pattern (the same pattern as the data electrode 21) of the surface of the printed layer 51 so that the region where the data electrode 21 is to be formed is selectively dried. In this way, a plurality of stripe-shaped dry regions 53 are formed by irradiating the regions with laser beams 52. Note that, although only one stripe is illustrated in this figure, the number, which is equivalent to the data electrodes, of stripe-shaped regions are formed in fact. This stripe-shaped region 53 is shaped like a dome in which the center portion is swelled.

Figure 6C:
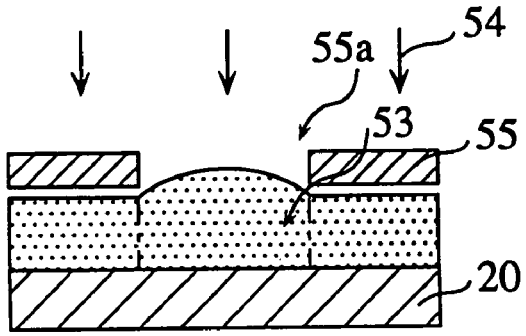

Next, as shown in FIG. 6C, this stripe-shaped region 53 is exposed to ultraviolet radiation 54 through a photolithographic mask 55 with a plurality of slits 55*a* corresponding to the stripe-shaped regions.

Figure 6D:
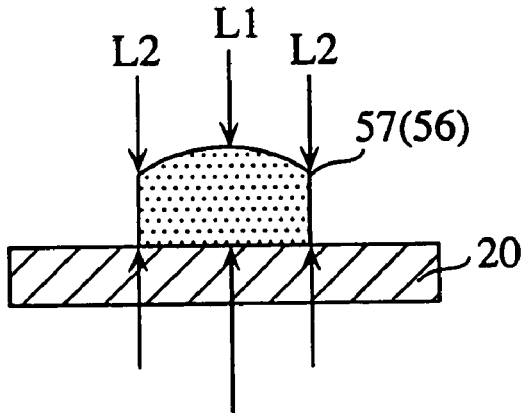

Next, as shown in FIG. 6D, a development process is performed to the printed layer using a suitable solution (for example, an $Na_2CO_3$ solution or the like) so that only the strip-shaped region 56 whose cross section is shaped like a dome is fixed on the surface of the second glass substrate 20. This region subjected to the development process will be called a "pre-baking electrode structure". 57.

Figure 6E:
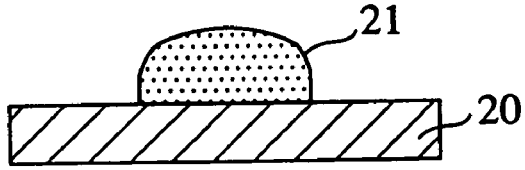

Next, this structure is baked at a predetermined temperature (e.g., 600° C.) to drive off polymers generated by the crosslinking reaction and the solvent used in the development process. Thereby, the data electrode 21 is completed (FIG. 6E). In the baking process, the size of the data electrode 21 is naturally reduced as compared to the pre-baking electrode structure 57.

[Functions and Effects]

The following describes specific functions and effects obtained by adopting the above methods.

A) Specific Functions and Effects of the Manufacturing Method of the Bus Electrode:

The following functions and effects can be obtained by manufacturing a bus electrode in the above manner. The pre-baking electrode structure 48 is formed as an intermediate of the bus electrode in the above processes. This structure 48, as shown in the cross-sectional view of FIG. 5G, is configured so that the pre-baking white layer 48*b* having a domical shape is laminated on the pre-baking black-white multiple layer 48*a* having a rectangular shape.

Now, FIG. 7 shows a state of the pre-baking electrode structure during a baking process, which illustrates that the edge portions are being warped upward by the action of the tensile force with the passage of time. The baking process proceeds in order of A, B, and C in FIG. 7.

Figure 7A:
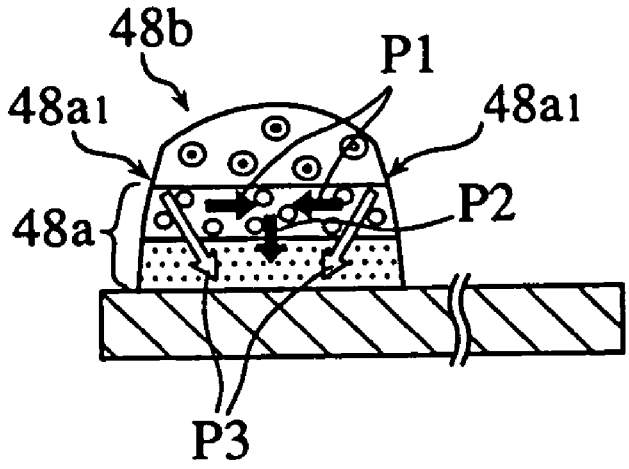
FIG. 7 shows a state of the pre-baking electrode structure during a baking process, which shows that the edge portions are being warped upward by the action of the tensile force with the passage of time.
Figure 7B:
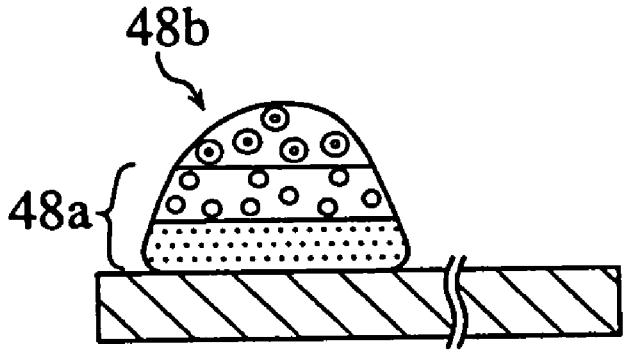
Figure 7C:
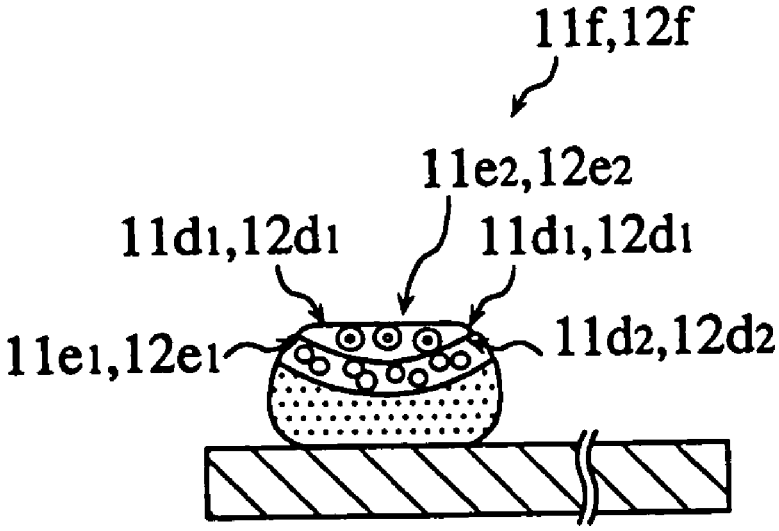

Originally, the structure has the shape shown in FIG. 7A, then it is gradually warped upward with the progress of the baking process as shown in FIG. 7B. Finally, as shown in FIG. 7C, the edge portions of the black-white multiple layers 11*d* and 12*d* are warped upward and concave portions 11*d*2 and 12*d*2 having arc-shaped curves are formed at their top. Then, the white layers 11*e* and 12*e* become domical shapes in which bottoms have swell portions 11*e*1 and 12*e*1 which swell downward in the arc shape and tops have flat portions 11e2 and 12e2. Those layers 11e and 12e fit into the concave portions 11d2 and 12d2 of the black-white multiple layers 11d and 12d respectively. In this way, the edge portions 11d1 and 12d1 of the black-white multiple layers, which are warped upward, contact the curved portions of the swell portions 11e1 and 12e1, and the electrodes on the whole have flat top surfaces 11e2 and 12e2, which prevents the warped edge portions 11d1 and 12d1 from being protruded and exposed.

When the baking process started, a resin component and the like included in the pre-baking electrode structure 48 start to be driven off. As a result, the pre-baking black-white multiple layer 48a shrinks along the horizontal and depth directions of the substrate. This shrinkage produces tensile forces P1 and P2 along the horizontal and depth directions of the substrate. These tensile forces produce a force P3 which acts from the edge portion 48a1 to the center line of the pre-baking black-white multiple layer 48a so as to warp the edge portion 48a1 upward.

As a result, as shown in FIG. 7B, the edge portion 48a1 of the pre-baking black-white multiple layer 48a is gradually warped upward. At the same time, the force P3 lets the pre-baking white layer 48b laminated on the layer 48a warp downward. Therefore, the pre-baking white layer 48b is gradually warped downward, so that it swells in the opposite direction to the pre-baking structure and becomes thinner in the depth direction, whereby it changes into a shape like a dome having a flat top surface.

Now, the reason why the pre-baking white layer 48b has a domical shape will be examined in detail. FIG. 8 schematically shows the mechanism.

Figure 8A:
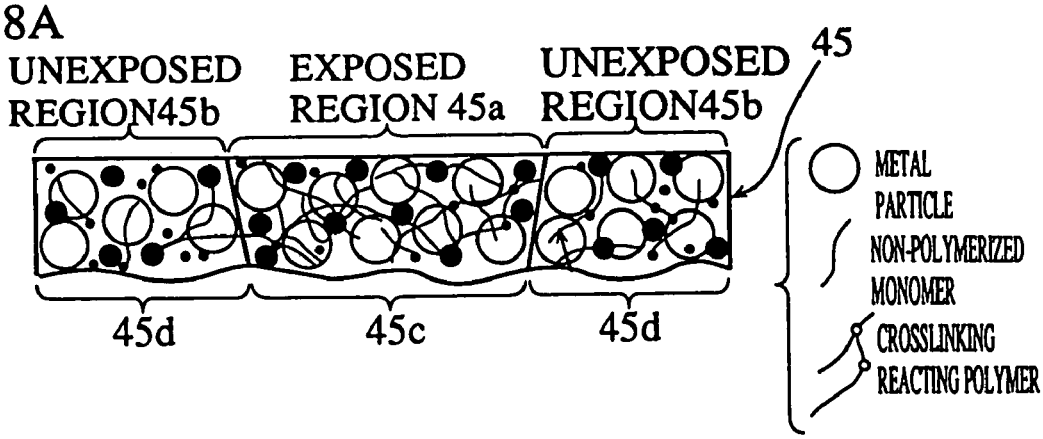
FIG. 8 is schematic diagrams showing a mechanism to make the pre-baking white layer a domical shape.

The exposed region 45a in the printed-exposed layer 45 has a higher absorbency of the solution than the unexposed regions 45b, because the photopolymerizability monomers included there were polymerized by the crosslinking reaction so that both dense and sparse regions are formed. Therefore, as shown in FIG. 8A, the portion corresponding to the exposed region 45a becomes a region 45c having a higher absorbency of the solution, while the portions corresponding to the unexposed regions 45b become regions 45d having a lower absorbency than the region 45c.

Figure 8B:
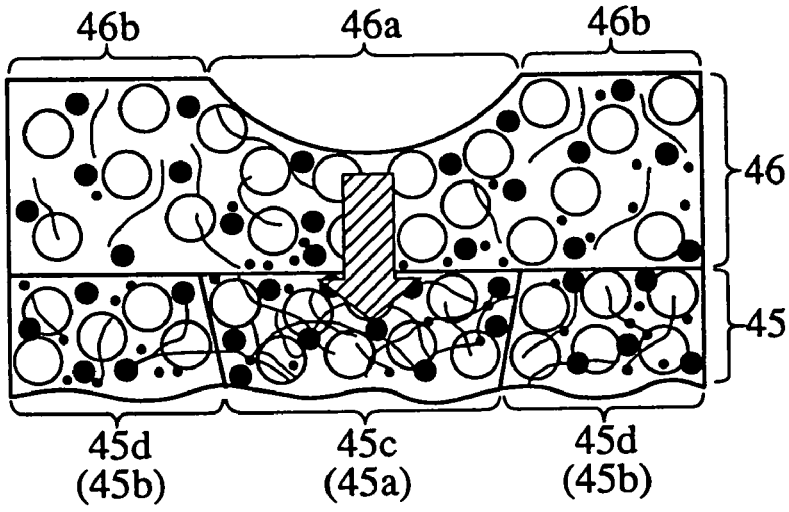

As a result, as shown in FIG. 8B, a concave portion is formed at the surface of the printed layer 46 which is printed on the printed-exposed layer 45, because the solvent included in the portion of the printed layer 46 on the exposed region 45a is selectively absorbed into the exposed region 45a. Thus, in the printed layer 46, the portion on the exposed region 45a becomes a region 46a being low in solvent content, while the portions on the unexposed regions 45b become regions 46b being higher in solvent content than 46a. These regions 46a and 46b are formed corresponding to the exposure pattern of the printed-exposed layer 45. In this case, these regions are formed in a stripe shape so that they are alternately arranged and in parallel.

Figure 8C:
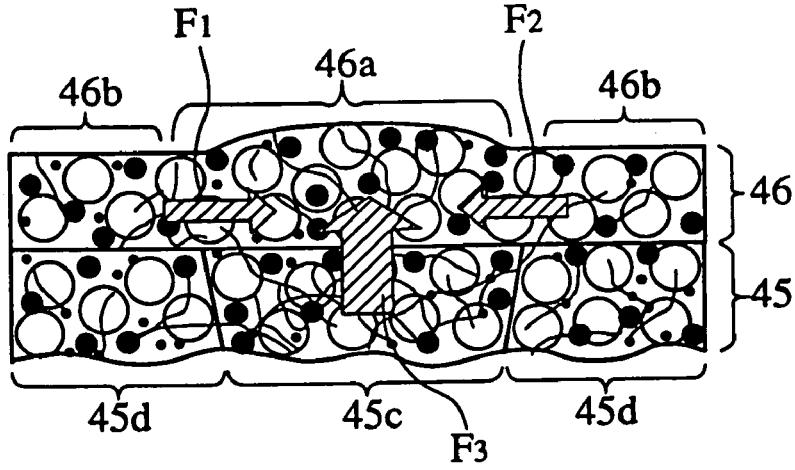

After that, the printed layer 46 is dried. In a conventional process, the solvent included in the printed layer is driven off in a so-called "static" state so that any flows of the solvent do not occur in the layer. In the embodiment of the invention, however, as shown in FIG. 8C, flows F1, F2, and F3 of the solvent occur in the horizontal and depth directions of the layer 46. When heated, the flows F1 and F2 is generated by the gradient of the solvent content between the region 46a being low in solvent content and the region 46b being higher in solvent content. The flow F3 occurs when the solvent flowed into the region 45c having a higher absorbency of the solution under the region 46a goes upward.

Meanwhile, a metal also flows into the region 46a with the flows F1 and F2 of the solvent. As a result, the metal density of the region 46a increases with the progress of the drying process, while the metal flows to the center portion of the region in accordance with the flows F1, F2, and F3 of the solvent, so that the metal is deposited on the top of the region. Thereby, as shown in FIG. 8C, the center portion of the region is finally swelled upward.

Since the flow of the solvent must generate during the drying process as above, it is preferable to use a solvent which is difficult to vaporize in a room temperature and whose boiling point is relatively high (this also applies to the following manufacturing method of the data electrode).

In the embodiment, the drying process is performed so that the top layer has a domical shape. However, if a drying process is performed so that the middle layer (i.e., printed layer 42) is swelled upward in the center portion, then the top layer laminated on the middle layer must have a swell portion corresponding to the middle layer. Therefore, this method is also feasible.

B) Specific Functions and Effects of the Manufacturing Method of the Data Electrode:

As shown in FIG. 6D, which shows the cross section of the pre-baking electrode structure 57, the structure has a domical shape in which the center portion is the thickest and the thickness is decreased in a curvature with increasing proximity to the edge portions.

It can be thought that this domical shape of the pre-baking electrode structure 57 allows the tensile forces acting on the pre-baking electrode structure due to the heat shrinkage to be balanced and suppresses the edge curl phenomenon.

Here, the effect to suppress the edge curl phenomenon depends on the difference between the film thickness L1 of the center portion of the pre-baking electrode structure 57 and the film thickness L2 of the edge portion (See FIG. 6D). As a result of the inventor's experiment, clear effects can be obtained when the difference between L1 and L2 was at least 2 μm.

Now, the reason why the domical shape is formed will be considered in detail. FIG. 9 schematically shows the mechanism.

Figure 9A:
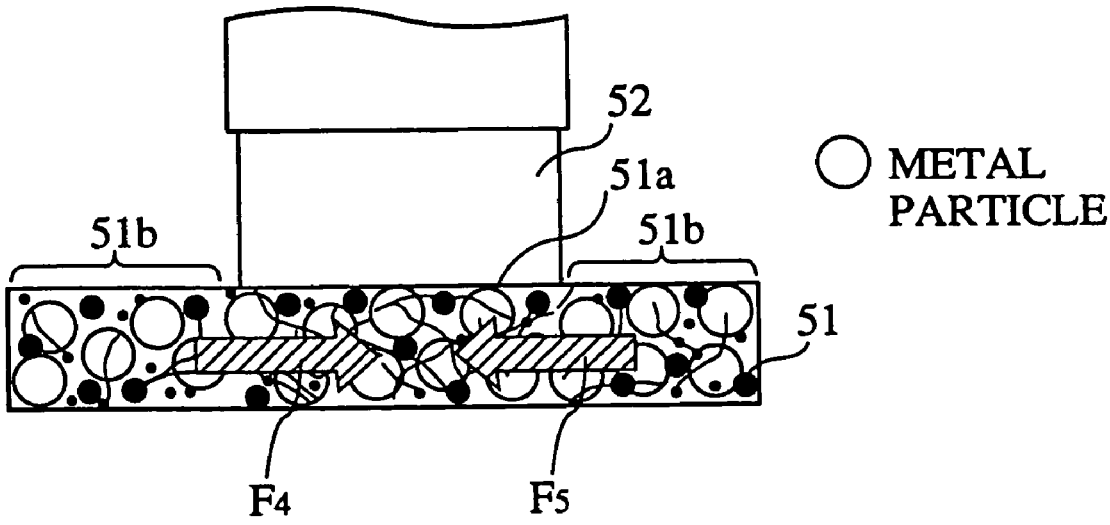
FIG. 9 is schematic diagrams showing a mechanism to make the pre-baking electrode structure a domical shape.

As shown in FIG. 9A, a laser beam 52 is irradiated to a specified portion of the surface of the printed layer 51 which is still wet, so that mainly a solvent is driven off from the irradiated region 51a. In accordance with this state, the flows of the solvent F4 and F5 occur so that the solvent flows from the non-irradiated regions 51b to the irradiated region 51a. This is because the absorbency of the solvent becomes higher in the irradiated region 51a because the solvent included in the region has been driven off. That is, two regions which are different from each other in their solvent content are formed. In this case, the metal also moves with the flows of the solvent.

Figure 9B:
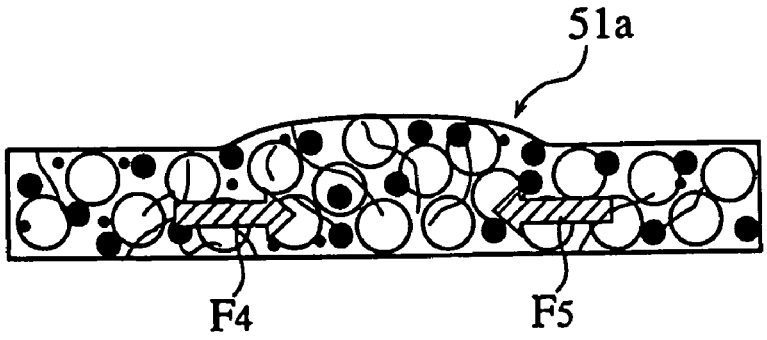

As a result, the metal density of the irradiated region 51a increases with the progress of the drying process, while the metal flows to the center portion of the region in accordance with the flows F4 and F5 of the solvent, so that the metal is deposited on the top of the region. Thereby, as shown in FIG. 9B, the center portion of the region is finally swelled upward.

This domical shape not only suppress the edge curl phenomenon, but also realize a relatively large cross-sectional area. Therefore, considering that the resistance of the electrode should be reduced, this shape is preferable. In addition, this shape can be formed according to the above simple method, so that this is of much practical use.

[Modifications]

Figure 10:
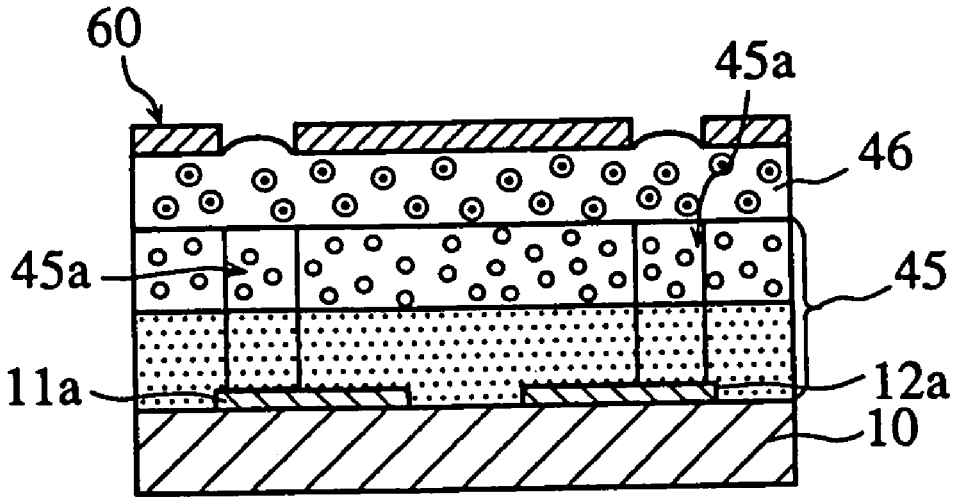
FIGS. 10–12 show example modifications of the method for producing the bus electrode and the data electrode.
Figure 11:
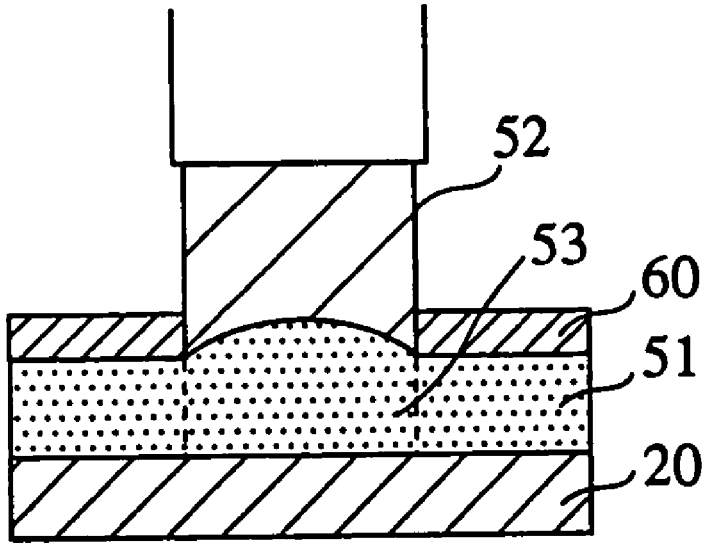

In the drying process of the above embodiments, the printed layer 46 is uniformly heated all over the surface or the printed layer 51 is selectively heated by laser beams. In addition to these heating process, as shown in FIGS. 10 and 11, the surface of the region not having the domical shape is covered with a member 60 having impermeability to the solvent so as to drive off the solvent from the surface of the domical shaped region, and not from the other surface. With this method, the flows of the solvent F1, F2, F4, and F5 along the horizontal direction of those printed layers effectively occur, so that the domical shape can be effectively formed.

The method for forming a domical shape of the white layer after the drying process is not limited to the above method. This shape can be formed in the following manner. The following describes different points between the methods.

Figure 12A:
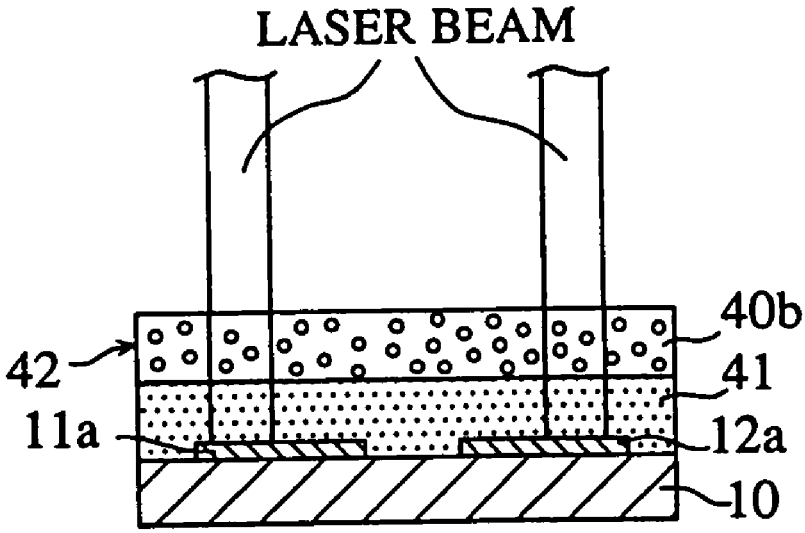

FIG. 12 shows the processes. In the above embodiment, two regions which are different from each other in their absorbency of the solvent are formed by exposing the printed layer 45 to light. However, in this modification, the two regions are formed by selectively drying the specified regions of the printed layer 45. That is, as shown in FIG. 12A, laser beams are irradiated to the region which is to be left as the electrode of the printed layer 42, so that the region is selectively dried and the absorbency of the solvent becomes higher in the region.

Figure 12B:
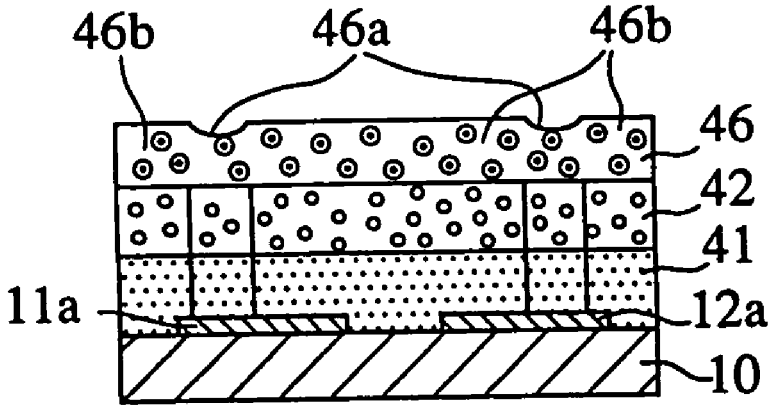

When the printed layer 46 is printed on the printed layer 42, the solvent included in the portion of the printed layer 46 which is located on the irradiated region is absorbed into the selectively dried region. As a result, as shown in FIG. 12B, this portion becomes the region 46*a* being low in solvent content, while the portions on regions not being subjected to the drying treatment in the printed layer 42 become regions 46*b* being higher in solvent content.

After that, the metal electrodes are completed according to substantially the same manner in the above embodiments. In this case, the printed layers for the black-white multiple layer and the white layer are subjected to exposure and development processes at the same time.

SECOND EMBODIMENT

The second embodiment is different from the first embodiment in that exposure values are different from each other in the exposure processes shown in FIGS. 5C and 5F.

Suppose that the exposure value is D1 when the printed layers which become the first conductive layers 11*b* and 12*b* and the second conductive layers 11*c* and 12*c* are exposed to light, while the exposure value is D2 when the printed layers which become the third conductive layers 11*e* and 12*e* (white layers) are exposed to light. Then, the exposure values D1 and D2 satisfy the relationship of D1>D2.

When the exposure value for exposing the printed layer for the white layer to light is set at lower than the printed layer for the black-white layer, it becomes possible to appropriately control the film thickness of the white layer, which allows the total film thickness of the metal electrode to be appropriately controlled.

This is because there is the following relationship between the exposure value and the dissolubility of the printed-exposed layer in a developer. That is, when the photosensitive paste after the drying process is exposed to light, the photosensitive component is polymerized by a crosslinking reaction. Such a polymerized portion has generally a lower dissolubility to the developer as compared to the unexposed regions. Therefore, the film thickness after the development process can be altered by changing the exposure value.

Figure 13:
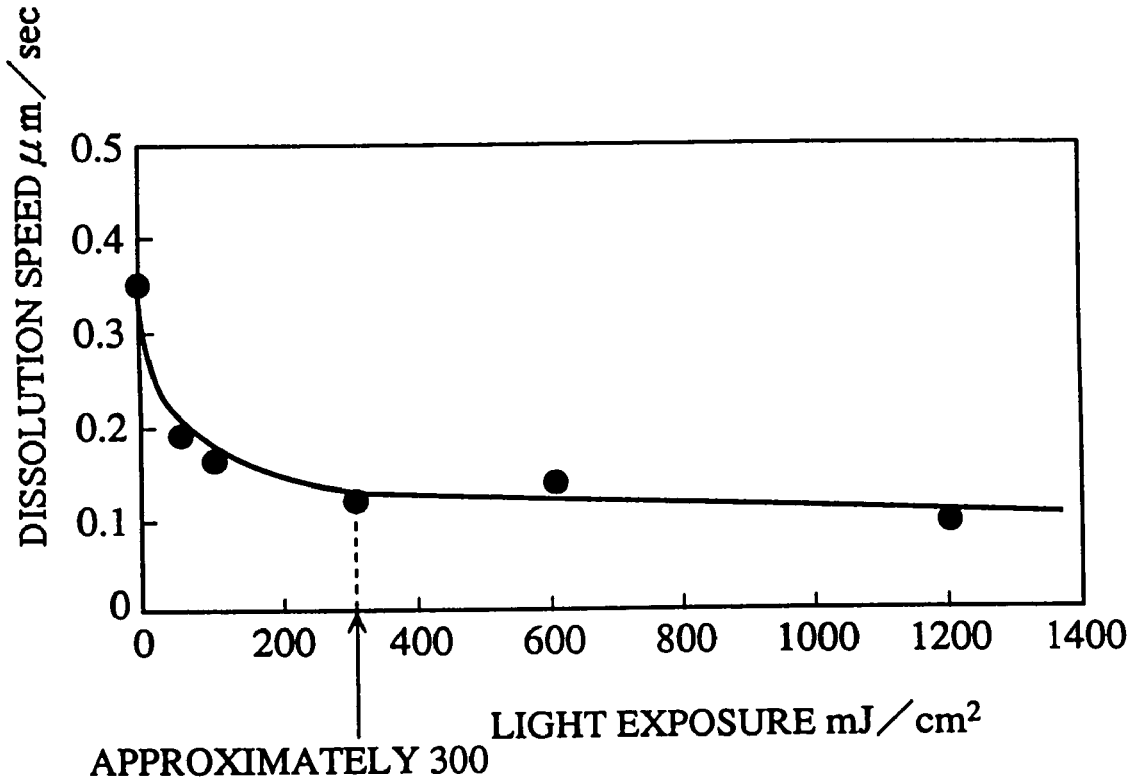
FIG. 13 shows a characteristic curve indicating a relationship between light exposure and dissolubility of the printed layer in a developer.
Figure 14:
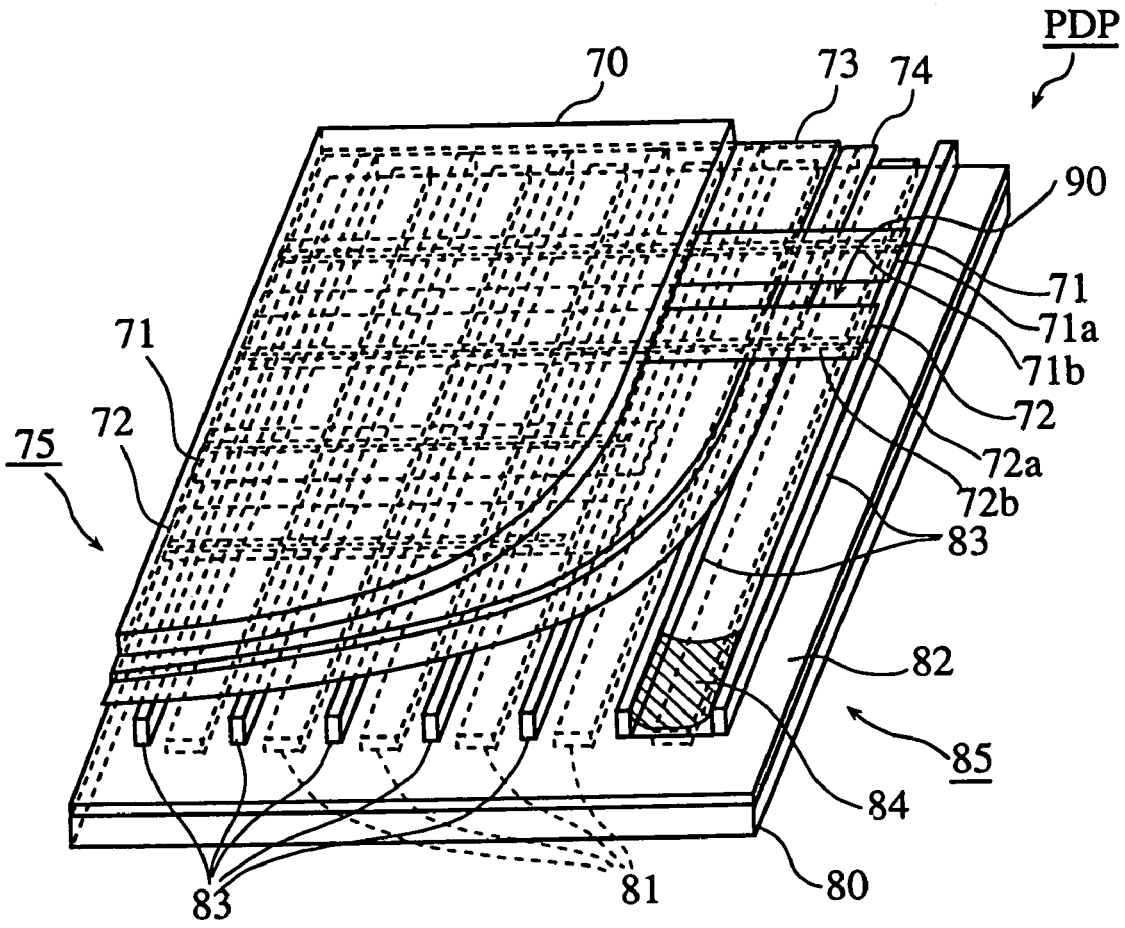
FIG.14 PRIOR ART
FIG. 14 is a perspective view showing the construction of a conventional PDP.
Figure 15A:
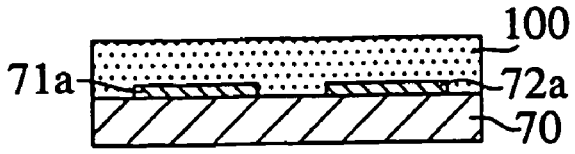
PRIOR ART FIG.15A
FIG. 15 shows processes in a conventional method for producing a bus electrode (single layer) and a data electrode.
Figure 15B:
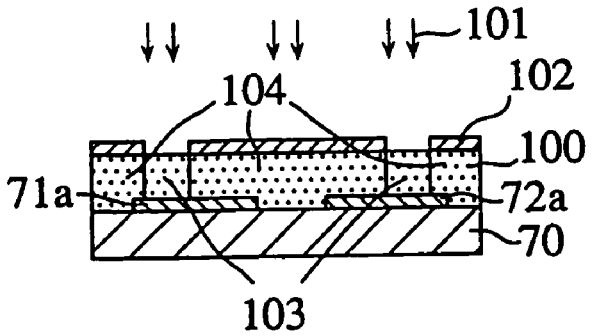
Figure 15C:
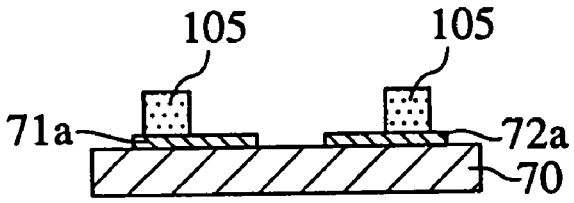
Figure 15D:
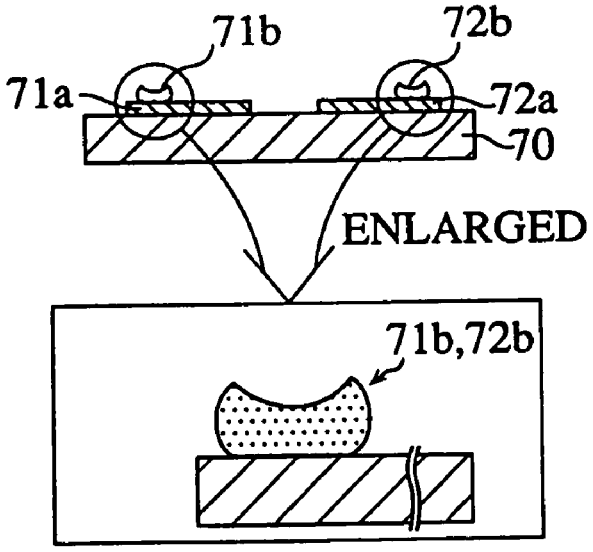
Figure 16A:
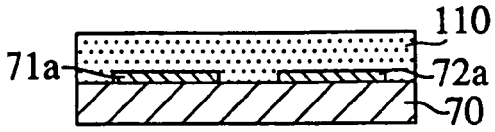
PRIOR ART FIG.16A
FIG. 16 shows processes in a conventional method for producing a bus electrode (optically double-layered structure).
Figure 16B:
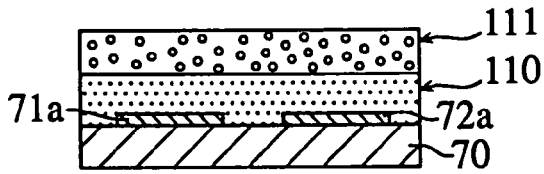
Figure 16C:
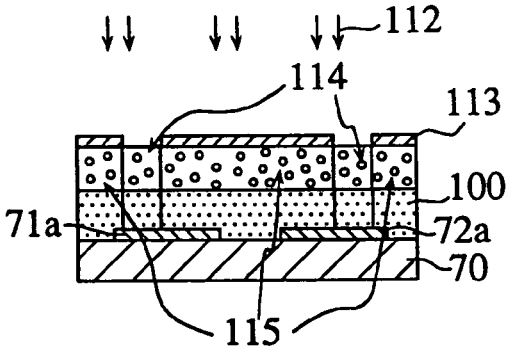
Figure 16D:
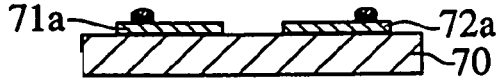
Figure 16E:
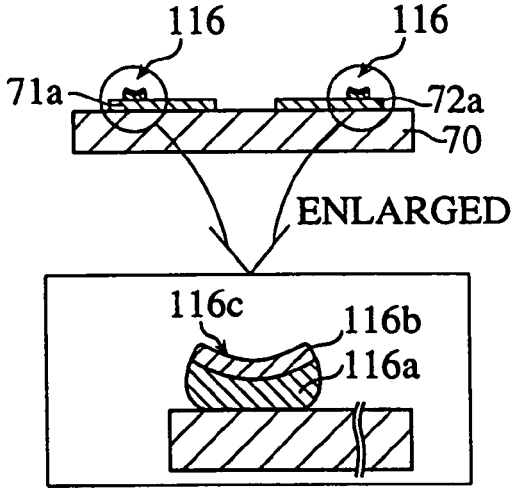
Figure 16F:
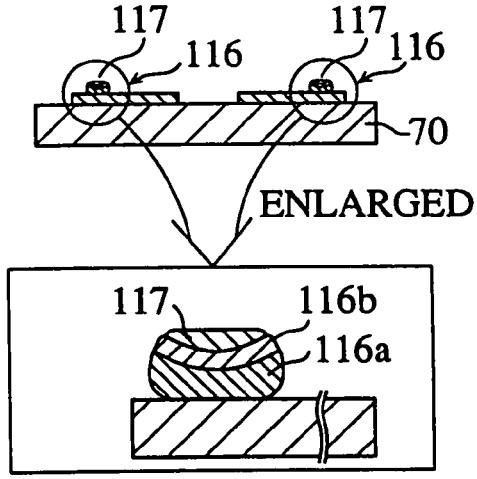

FIG. 13 shows a characteristic curve indicating a relationship between light exposure and dissolubility of the printed layer in a developer. The horizontal axis shows the exposure value (mJ/cm$^2$), and the vertical axis shows the dissolution rate (μm/sec). This experimental result was obtained by immersing the substrate, to which the photosensitive paste is applied, in the developer and measuring the remaining film thickness per unit of time.

As shown in this FIG. 13, the dissolution rate is gradually decreased with increasing the light exposure not more than 300 mJ/cm$^2$. When the light exposure is more than 300 mJ/cm$^2$, the dissolution rate does not change very much with increasing the light exposure. From this observation, the film thickness after the development process can be altered by setting two exposure values. More specifically, in the case of FIG. 13, two values may be selected with setting a boarder of 300 mJ/cm$^2$.

As stated above, the film thickness after the development process can be controlled by suitably changing the exposure value. With this method, if the properties of panels which were manufactured in the same condition are uneven, this unevenness can be easily corrected by fine-tuning the light exposure.

For information, the following Table 1 shows the film thicknesses of the black-white multiple layer and the white layer when the exposure values D1 and D2 are changed. It is apparent from this result also that adjustment of the light exposure is effective in controlling the film thickness.

TABLE 1

| | Light Exposure D1 (mJ/cm$^2$) | Light Exposure D2 (mJ/cm$^2$) | Black-White Multiple Layer (μm) | White Layer (μm) |
|---|---|---|---|---|
| Case 1 | 500 | 100 | 5.0 | 4.8 |
| Case 2 | 400 | 200 | 5.1 | 6.8 |
| Case 3 | 400 | 100 | 5.3 | 5.0 |
| Case 4 | 300 | 100 | 5.1 | 5.2 |
| Case 5 | 300 | 50 | 5.1 | 3.2 |
| Case 6 | 300 | 300 | 5.1 | 8.4 |

Here, since the above example deals with the case for making the white layer thinner, the light exposure condition is set at D1>D2. However, in the case of D1<D2, the white layer can be formed thicker.

Besides, if the exposure process is individually performed to each of the first and the second conductive layers unlike the above embodiments, the exposure value can be controlled for each of the first, second, third conductive layers. In this case, each film thickness can be appropriately controlled.

INDUSTRIAL APPLICABILITY

The invention offers an excellent industrial applicability, because metal electrodes in display panels such as PDPs can be manufactured with great productivity.

The invention claimed is:

1. An electrode for use in a plasma display device including at least one type of metal and being formed on a substrate, wherein the electrode has such a cross-sectional shape in which a film thickness is larger in a center portion than in end portions.

2. The electrode for use in a plasma display device according to claim 1, wherein the electrode has a cross-sectional shape taken along a shorter side direction thereof in which the film thickness is largest in the center portion and is decreased in a curvature with increasing proximity to the edge portions in the shorter side direction.

3. The electrode for use in a plasma display device according to claim 2, wherein the electrode has a dome shape in which a center portion swells upward against the substrate.

4. A plasma display panel comprising:

a substrate including the electrode according to claim 1, the electrode being convex in the width direction of the substrate; and a front panel and/or a rear panel.

5. A photosensitive electrode for use in a plasma display device, including at least one type of metal and being is structured by laminating a layer B on at least a layer A formed on a substrate, wherein the layer B has such a cross-sectional shape in which a film thickness is larger in a center portion than in end portions.

6. The photosensitive electrode for use in a plasma display device according to claim 5, wherein the layer A is structured by laminating a layer D on a layer C, and has a cross-sectional shape having a concave portion at a top, and the layer B has a cross-sectional shape having a swell portion which swells toward a bottom.

7. The photosensitive electrode according to claim 6, wherein the concave portion of the layer A has an arc-shaped curve.

8. The photosensitive electrode according to claim 6, wherein the layer B has a flat portion at a top.

9. The photosensitive electrode according to claim 6, wherein the layer C is black, and the layers D and B are white.

10. The photosensitive electrode according to claim 5, wherein the electrode is formed on a transparent electrode that is formed on the substrate.

11. A plasma display panel comprising:

a substrate including the electrode according to claim 1; and a front panel and/or a rear panel.

* * * * *